United States Patent [19]

Fox

[11] Patent Number: 4,810,925

[45] Date of Patent: Mar. 7, 1989

[54] DIRECTLY HEATED CATHODES

[75] Inventor: David B. Fox, Chelmsford, United Kingdom

[73] Assignee: English Electric Valve Company Limited, Chelmsford, United Kingdom

[21] Appl. No.: 47,106

[22] Filed: May 8, 1987

[30] Foreign Application Priority Data

May 16, 1986 [GB] United Kingdom ..... 8611967

[51] Int. Cl.[4] ..... H01J 1/13

[52] U.S. Cl. ..... 313/342; 313/341; 313/345; 313/352; 313/254; 313/39.63

[58] Field of Search ..... 313/341, 342, 345, 352, 313/354; 315/39.63

[56] References Cited

U.S. PATENT DOCUMENTS

| | | | |
|---|---|---|---|
| 633,350 | 9/1899 | Thowless | 313/341 |
| 792,001 | 6/1905 | Callan | 313/341 |
| 1,701,356 | 2/1929 | Bruckel et al. | 313/342 |
| 1,881,644 | 10/1932 | Jones | 313/342 |
| 2,092,815 | 9/1937 | Shaw | 313/340 |
| 2,172,207 | 9/1939 | Kolligs | 313/341 |
| 2,473,550 | 6/1949 | Spencer | 313/341 |
| 2,675,948 | 4/1954 | Cronin | 313/345 X |
| 2,682,511 | 6/1954 | Cronin | 313/341 X |
| 3,221,203 | 11/1965 | Ragland, Jr. | 313/271 |
| 3,766,423 | 10/1973 | Menelly | 313/311 |
| 4,634,921 | 1/1987 | Williams et al. | 313/342 |

FOREIGN PATENT DOCUMENTS

| | | | |
|---|---|---|---|
| 630624 | 10/1949 | United Kingdom | 313/340 |
| 1083833 | 9/1967 | United Kingdom | 313/340 |
| 1359789 | 7/1974 | United Kingdom | 313/342 |
| 1378620 | 12/1974 | United Kingdom | 313/340 |
| 1418196 | 12/1975 | United Kingdom | 313/342 |
| 1431571 | 4/1976 | United Kingdom | 313/340 |
| 2074370A | 10/1981 | United Kingdom | 313/340 |
| 2102196A | 1/1983 | United Kingdom | 313/340 |

*Primary Examiner*—David K. Moore
*Assistant Examiner*—Mark R. Powell
*Attorney, Agent, or Firm*—Spencer & Frank

[57] ABSTRACT

A directly heated cathode comprises a metal tube having a filling of powdered metal which extends beyond the tube and in which is embedded an electrical wire which is coaxial and extensive with said the outer tube over part of its length. The electrical wire is coated with insulating material which is normally alumina. The tube, the metal powder filling and the wire are sintered together, giving a relatively robust structure.

10 Claims, 1 Drawing Sheet

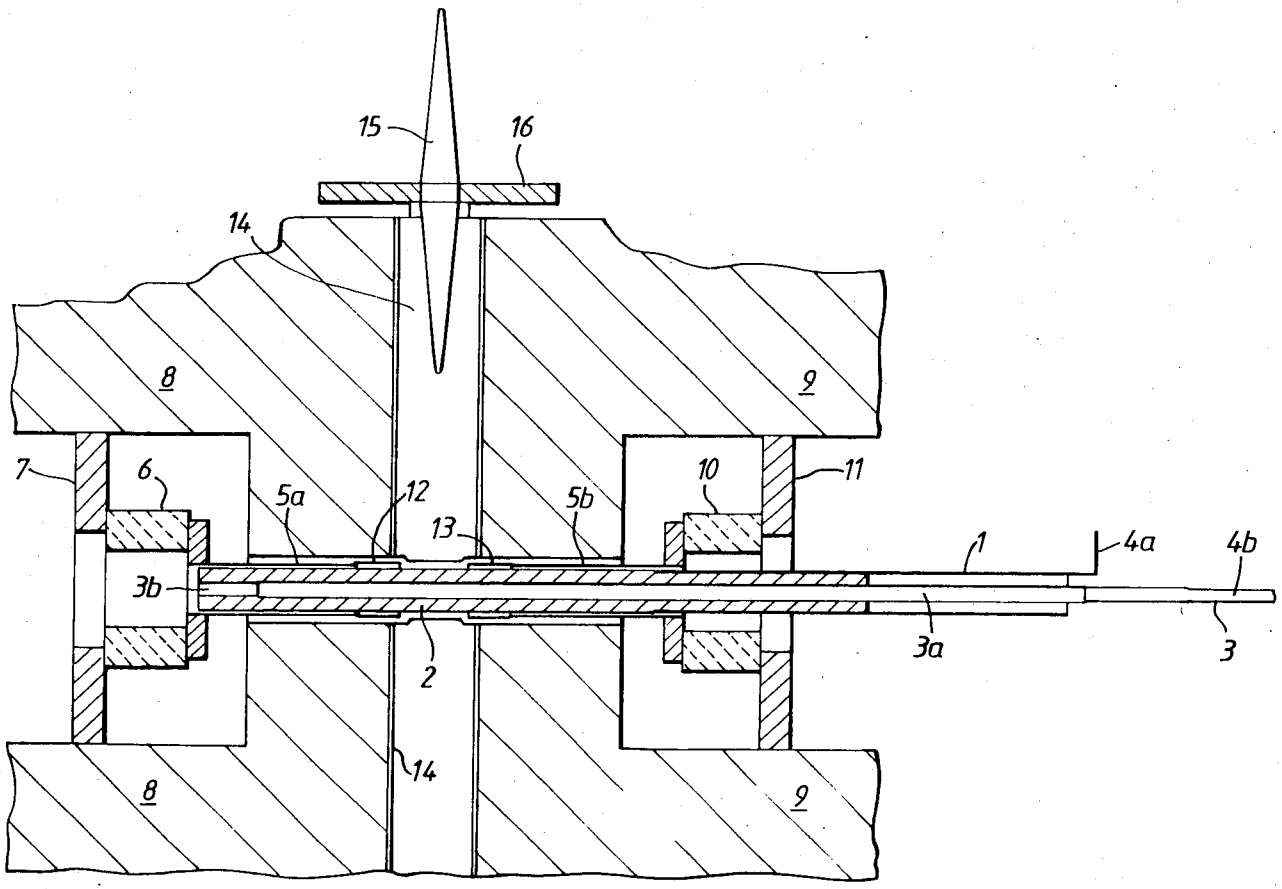
4b
3
4a
1
3a
11
9
9
10
5b
16
13
2
14
12
15
5a
14
8
6
3b
8
7

DIRECTLY HEATED CATHODES

BACKGROUND TO THE INVENTION

This invention relates to directly heated cathodes and in particular, though not exclusively, to directly heated cathodes for use in magnetron and similar electronic devices.

SUMMARY OF THE INVENTION

One object of the present invention is to provide improved directly heated cathodes, and electronic devices utilising the same, of relatively rugged construction.

According to this invention a directly heated cathode comprises, sintered together, an elongate powdered metal substrate or mush having embedded therein and co-extensive therewith for at least a substantial part of the length thereof, a wire which is coated with an insulating material whereby the wire is electrically isolated from the substrate, electrical connections for the cathode to the substrate and to the wire being at the same end of the elongate sintered assembly and the path for heater current comprising the substrate and the wire.

Preferably the wire acts as a return path for the heater current.

Preferably the substrate is tubular and the tubular substrate and the wire are coaxial.

Preferably the substrate is partially encased in an outer metal tube with the outer tube, the powdered metal of the substrate and the wire all being sintered together.

Preferably, where the outer metal tube is included, an electrical connection for the substrate is made at one end of the tube, the wire emerging from the substrate at the same end of the tube.

Normally the wire and, where the same is provided, the outer tube, are of a material having a co-efficient of thermal expansion similar to that of the powdered metal of the substrate, after sintering.

Preferably the thickness of the wire is chosen such that its electrical heating effect per unit length is similar or equivalent to that of the powdered metal of the substrate, after sintering.

BRIEF DESCRIPTION OF THE DRAWING

The invention is illustrated in and further described by way of example with reference to the accompanying drawing which shows, partly in longitudinal section the cathode and output arrangements of one electronic device, in this case a magnetron, in accordance with the present invention.

DESCRIPTION OF A PREFERRED EMBODIMENT

Referring to the drawing, the cathode itself consists of a cylindrical metal tube 1 within which is a filling 2 of powdered metal through the middle of which passes a return heater wire 3, which is not shown in section for the sake of clarity. As will be seen, the powdered metal filling 2 extends beyond one end of the tube 1, so that part of the filling 2 shown to the right as viewed is contained within the tube 1 and that to the left is outside it. The return heater wire 3 is coated with alumina 3a (e.g. by spraying) where it would otherwise be in contact with the powdered metal filling 2, so as electrically to insulate the one from the other. The end 3b of the wire 3 other than that to which external connection is made is bare of alumina, to provide electrical contact between the wire 3 and the filling 2 at the left-hand end of the cathode as shown. The tube 1, coated heater wire 3 and powdered metal filling 2 are sintered together. The substrate formed by the sintered powdered metal is impregnated with emissive material and electrical connections 4a and 4b for directly heating the cathode thus formed are provided at the same end of the cathode tube 1 and the return heater wire 3 respectively. The materials of the tube 1 and the return wire 3 are chosen to have a coefficient of thermal expansion similar to that of the powdered metal filling 2, after sintering, and the thickness of the return wire 3 is chosen such that its electrical heating effect per unit length is equivalent to that of said filling 2, after sintering.

Metallic "end hat" tubes **5*a* and 5*b* are provided to carry the cathode assembly 1,2,3. "End hat" tube 5*a* is carried by a ceramic insulator 6 which is attached to a support washer 7 mounted upon one (referenced 8) of the pole pieces of the magnetron. "End hat" tube 5*b* is similarly carried by a ceramic insulator 10 mounted on a support washer 11 which is mounted upon the other pole piece (referenced 9**) of the magnetron.

The cathode support tubes **5*a* and 5*b* are referred to as "end hat" tubes because both are flared at their innermost ends 12, 13** respectively so as to duplicate the function of conventional "end hats" and act to constrain the generated space charge.

In assembling the cathode structure, the "end hat" tubes **5*a* and 5*b* are assembled so as to be carried separately by their respective ceramic insulators 6,10, support washers 7,8 and pole pieces 8,9 with concentricity achieved by jigging. The "end hat" tubes 5*a*, 5*b* mounted within the pole pieces 8,9 and assembled with the magnetron anode 14 are then ready to accept the completely processed cathode with its cathode tube 1**, from one end (the right-hand end as viewed).

Not only does the arrangement and assembly described above provide for good anode-cathode concentricity but also the structure tends to be "rugged". The operation of the device is, within limits, independent of the cathode axial position whilst electrical connection to the cathode, via the cathode tube 1 and return wire 3 tends to be relatively easy to achieve. The construction also tends to simplify the achievement of vacuum integrity.

It will be noted that the output waveguide from the anode 14 of the magnetron is closed by a high frequency window consisting of a ceramic rod 15 passing through a closure wall 16. Ceramic rod 15 is formed with a conical taper on either side of the closure wall 16.

I claim:

1. A directly heated cathode comprising:

an elongated powdered metal substrate having first and second ends, said substrate including an electron emissive material;

a wire having a length with first and second ends, said wire being coated with an insulating material so that said wire is electrically isolated from said substrate over most of its length, said wire being embedded in and co-extensive with said substrate for at least a substantial part of its length; and electrical connections for said cathode operatively connected to said substrate and to said wire, said connections being located at said first ends of said substrate and said wire; and wherein said substrate and said wire are sintered together, whereby the path for heater current is through said substrate and said wire.

2. A cathode as claimed in claim 1 wherein said wire acts as a return path for the heater current.

3. A cathode as claimed in claim 1 wherein said substrate has a shape tubular and said substrate and said wire are coaxially disposed.

4. A cathode as claimed in claim 1, further comprising an outer metal tube, said substrate being partially encased in said tube, and wherein said tube, said substrate and said wire are sintered together.

5. A cathode as claimed in claim 4, wherein said tube has first and second ends, said electrical connection for said substrate being connected at said first end of said tube, and said wire emerging from said substrate at said first end of said tube.

6. A cathode as claimed in claim 1 wherein said wire is composed of a material having a co-efficient of thermal expansion similar to that of the powdered metal of said substrate after sintering.

7. A cathode as claimed in claim 6, further comprising an outer metal tube, said substrate being partially encased in said outer metal tube, and wherein said tube, said substrate and said wire are sintered together, and said tube being composed of a material having a co-efficient of thermal expansion similar to that of the powdered metal of said substrate after sintering.

8. A cathode as claimed in claim 1 wherein said wire has a thickness chosen such that its electrical heating effect per unit length is similar or equivalent to that of the powdered metal of said substrate, after sintering.

9. An electronic device including a cathode as claimed in claim 1.

10. A magnetron including a cathode as claimed in claim 1, wherein said cathode is assembled prior to its insertion into said magnetron.

* * * * *